US010927497B2

(12) United States Patent
Berry et al.

(10) Patent No.: US 10,927,497 B2
(45) Date of Patent: Feb. 23, 2021

(54) METHODS FOR THE PRODUCTION OF HIGH ALPHA-CELLULOSE PULP

(71) Applicant: Inventure Renewables, Inc., Tuscaloosa, AL (US)

(72) Inventors: William W. Berry, Lakeland, FL (US); William Rusty Sutterlin, Hoover, AL (US); Mark G. Tegen, Gig Harbor, WA (US); Cory Blanchard, Birmingham, AL (US)

(73) Assignee: Inventure Renewables Inc., Tuscaloosa, AL (US)

( * ) Notice: Subject to any disclaimer, the term of this patent is extended or adjusted under 35 U.S.C. 154(b) by 359 days.

(21) Appl. No.: 15/320,734

(22) PCT Filed: Jun. 26, 2015

(86) PCT No.: PCT/US2015/038138
§ 371 (c)(1),
(2) Date: Dec. 20, 2016

(87) PCT Pub. No.: WO2015/200868
PCT Pub. Date: Dec. 30, 2015

(65) Prior Publication Data

US 2017/0121906 A1 May 4, 2017

Related U.S. Application Data

(60) Provisional application No. 62/018,495, filed on Jun. 27, 2014.

(51) Int. Cl.
*D21C 9/08* (2006.01)
*D21C 9/00* (2006.01)
(Continued)

(52) U.S. Cl.
CPC ..... *D21C 9/08* (2013.01); *C13K 1/04* (2013.01); *D21C 3/00* (2013.01); *D21C 9/004* (2013.01)

(58) Field of Classification Search
CPC ..... C08B 37/14; D21C 9/08
See application file for complete search history.

(56) References Cited

U.S. PATENT DOCUMENTS 1,774,403 A 8/1930 Richter
2,218,479 A 10/1940 Peterson et al.
(Continued)

FOREIGN PATENT DOCUMENTS

WO 2012070072 A2 5/2012

OTHER PUBLICATIONS

Rydholm, Pulping Processes, 1965, Interscience Publishers, chapter 15. (Year: 1965).*
(Continued)

*Primary Examiner* — Anthony Calandra
(74) *Attorney, Agent, or Firm* — Greer, Burns & Crain, Ltd.; Gregory P. Einhom

(57) ABSTRACT

In alternative embodiments, provided herein are methods and industrial processes for generating high purity (high alpha cellulose) pulp from lignocellulosic feedstocks, comprising directly contacting a lignocellulosic feedstock with a system comprising a super critical or near-super critical fluid or mixture of fluids, whereby the partial pressure of the system provides for the alcoholysis, hydrolysis or a combination thereof of the feedstock at reduced temperatures and pressures, followed by an upgrading step wherein a low-purity cellulosic material generated in the super critical or near-super critical reaction step is treated with an alkaline
(Continued)

solution. Also provided herein are systems and methods for producing a high purity cellulose material using reduced amounts of alkaline material.

28 Claims, 3 Drawing Sheets

(51) Int. Cl.
*C13K 1/04* (2006.01)
*D21C 3/00* (2006.01)

(56) References Cited

U.S. PATENT DOCUMENTS 3,935,022 A * 1/1976 Sihtola ..... D21H 17/24 106/166.01
5,041,192 A * 8/1991 Sunol ..... D21C 3/22 162/63
5,430,142 A * 7/1995 Glasser ..... C08B 37/0057 536/115
8,546,561 B2 10/2013 Kilambi
2005/0065336 A1 3/2005 Karstens
2008/0110586 A1* 5/2008 Li ..... D21C 9/08 162/80
2009/0312536 A1* 12/2009 Sixta ..... D21C 9/004 536/60
2012/0211183 A1* 8/2012 Leavitt ..... D21C 1/04 162/37

OTHER PUBLICATIONS

Hui Cui, Second Office Action for Chinese Patent Application 201580002644.7 dated Oct. 29, 2018.
Copenheaver, Blaine, "Notification of Transmittal of the International Search Report and the Written Opinion of the International Searching Authority, or the Declaration", Patent Cooperation Treaty Application No. PCT/US2015/038138, United States Patent Office as Search Authority, dated Sep. 21, 2015, 4 pages.
Copenheaver, Blaine, "Notification of Transmittal of the International Search Report and the Written Opinion of the International Searching Authority, or the Declaration", Patent Cooperation Treaty Application No. PCT/US2015/038138, United States Patent Office as Search Authority, dated Sep. 21, 2015, 7 pages.
Hui Cui, First Office Action for Chinese Patent Application 201580002644.7 dated Jan. 3, 2018.

* cited by examiner

METHODS FOR THE PRODUCTION OF HIGH ALPHA-CELLULOSE PULP

RELATED APPLICATIONS

This application is a national phase application claiming benefit of priority under 35 U.S.C. § 371 to International Patent Convention Treaty (PCT) International Application serial number PCT/US2015/038138, filed Jun. 26, 2015, which claims the benefit of priority under 35 U.S.C. § 119(e) of U.S. Provisional Application Serial No. (USSN) 62/018,495, filed Jun. 27, 2014. The aforementioned applications are expressly incorporated herein by reference in their entirety and for all purposes.

FIELD OF THE INVENTION

This invention generally relates to the treatment of feedstocks comprising lignocellulose. More particularly, in alternative embodiments, provided herein are methods and industrial processes for generating high purity (e.g., high alpha cellulose) pulp from lignocellulosic feedstocks, comprising directly contacting a lignocellulosic feedstock with a system comprising a super critical or near-super critical fluid or mixture of fluids, whereby the partial pressure of the system provides for the alcoholysis, hydrolysis or a combination thereof of the feedstock at reduced temperatures and pressures, followed by an upgrading step wherein a low-purity cellulosic material generated in the super critical or near-super critical reaction step is treated with an alkaline solution. Also provided herein are systems and methods for producing a high purity cellulose material using reduced amounts of alkaline material.

BACKGROUND

Pulp from cellulosic wood and other plant fibers is used in a large number of commercial applications. The most common use of pulp is in the manufacturing of paper products, although a number of higher-value products can also be produced from pulp including rayon and other synthetics, as well as cellulose acetate and cellulose esters used in the manufacturing of explosives, packaging films and other products.

The "pulping" process refers to the separation of cellulose fibers from their lignocellulosic structures. Lignocellulosic material comprises a network of complex polymers including cellulose, hemicellulose, lignin, and other minor components. In order to generate a useable fiber product, the lignin molecules must be fragmented in order to liberate the individual cellulosic fibers from the network.

The most widely used pulping process is the kraft process. In a conventional kraft mill, a cellulose-containing material, typically sized-reduced wood, is treated with an aqueous mixture of sodium hydroxide and sodium sulfide, referred to as "white liquor". The white liquor treatment serves to break down linkages between the lignin and the cellulose fibers and also serves to degrade and solubilize a substantial portion of the hemicellulose present in the wood. The soluble hemicellulose fraction is separated from the cellulose product, which is then subjected to any number of downstream upgrading and finishing steps, depending on the desired end product.

The kraft process, as described above, typically produces fairly low-grade pulps with alpha cellulose contents in the range of between about 84- to 88-alpha. The resulting kraft pulp can either be used directly in the production of paper, cardboard, or various other end products, or subjected to an upgrading process in order to increase the alpha cellulose content of the pulp by further separating a portion of the remaining hemicellulose impurities. The upgrading step typically comprises contacting the kraft pulp with a strong caustic solution in order to cleave a portion of the remnant hemicellulose from the pulp, followed by a washing step in order to separate the cellulose product from an aqueous phase containing the hemicellulose and caustic.

The kraft process described above requires the use of a substantial amount of chemicals and produces a variety of toxic waste streams that must be managed and treated in order to mitigate environmental risks. The cost of waste management at a kraft-pulping mill can comprise a significant portion of the overall processing costs.

In addition to the kraft process described above, the "sulfite" process is used to produce high purity pulps with alpha cellulose contents in the range of 90 to 96 alpha or above, referred to as "dissolving" grade pulps. In the sulfite process, salts of sulfuric acid are used to extract lignin and hemicellulose from wood. While the sulfite process is capable of producing a high purity alpha cellulose pulp, it is limited in the range of feedstocks it can accept, and requires the use of a large volume of toxic chemicals, of which only a relatively small portion can be recovered.

A further limitation of both the kraft and sulfite processes is their need to utilize feedstocks with relatively high cellulose contents, primarily woods, as high relative amounts of hemicellulose necessitates the increased consumption of pulping liquor. Further, hemicellulose is considered a by-product of the pulping process and is generally not recovered for any value-added applications.

As can be seen from the forgoing description of the prior art, there exists a need for a process to produce high purity (i.e. high alpha-cellulose) pulps that consumes a minimal amount of chemicals, produces little to no environmental contaminants, and is capable of handling a range of lignocellulosic feedstocks, including agricultural and forest wastes.

SUMMARY OF THE INVENTION

In alternative embodiments, provided herein are methods and industrial process for the production of high alpha-cellulose pulp from a lignocellulosic feedstock comprising:

(a) contacting a lignocellulosic feedstock with a fluid comprising water and, optionally, an alcohol, to form a reaction mixture at a temperature in the range of between about 150° C. to about 250° C., and a pressure in the range of between about 200 psi to about 1000 psi, or between about 200 psi to about 1500 psi, for a time period, or optionally the fluid is in a "supercritical state", and optionally a fluid in a "supercritical state" is a fluid that is at, near (substantially close to), or above the critical point of at least one component of the fluid;

thereby generating a reaction slurry comprising at least a cellulose product or cellulose-comprising product, the cellulose product or cellulose-comprising product having an alpha number in the range of between about 80 and 90, or an alpha number of about 80, 81, 82, 83, 84, 85, 86, 87, 88, 89, 89.5 or 90; and (b) recovering the cellulose product or cellulose-comprising product from the reaction slurry; and (c) contacting the cellulose product or cellulose-comprising product with a caustic solution having a pH in the range of between about pH 10 and 14, or a pH of about 9, 10, 11, 12, 13, or 14; thereby increasing the alpha number of the cellulose product to between about 92 and 99 alpha, or between about 90 and 99.5 alpha, or an alpha number of about 90, 91, 92, 93, 94, 95, 96, 97, 98, 99 or 99.5.

In alternative embodiments, provided are methods and industrial processes for the production of an alpha-cellulose pulp comprising:

(a) providing a lignocellulosic feedstock;

(b) contacting the lignocellulosic feedstock with a fluid comprising a water and, optionally, an alcohol, to form a reaction mixture at a temperature in the range of between about 150° C. to about 250° C. and a pressure in the range of between about 200 psi to about 1500 psi, for a time period sufficient to generate a reaction slurry comprising at least one cellulose product having an alpha number in the range of between about 80 and 90.

In alternative embodiments, the methods and industrial processes further comprise recovering the cellulose product from the reaction slurry.

In alternative embodiments, the methods and industrial processes further comprise contacting the recovered cellulose product with a caustic solution having a pH in the range of between about 10 and 14, for a time sufficient to increase the alpha number of the cellulose product to between about 92 and 99 alpha, wherein optionally the contacting of the cellulose product with the caustic solution generates a solubilized hemicellulose (optionally including solubilized xylan, glucuronoxylan, arabinoxylan, glucomannan, and xyloglucan) that is separated from the caustic material, optionally by a nanofiltration or equivalent process, and optionally the process comprises a "cold-caustic" extraction process.

In alternative embodiments, of the methods and industrial processes, the lignocellulosic feedstock comprises a low alpha-cellulose kraft pulp, optionally a kraft pulp with alpha cellulose content in the range of between about 84% to about 88% alpha-cellulose.

In alternative embodiments, of the methods and industrial processes provided herein, the lignocellulosic feedstock comprises: a wood, optionally a hardwood or a softwood; a cotton fiber; a grass or any plant of the genus *Miscanthus*; a straw; a cane; an agricultural residue, optionally a corn cob or a corn husk, or a sugar cane bagasse; a residue generated in an oil palm production process, or a palm tree (or any plant of the family Arecaceae) harvesting or production process, and optionally a palm mesocarp fiber; a palm frond or a palm trunk; a rice husk; a rice bran; or, any combination thereof.

In alternative embodiments provided herein are methods or industrial processes for the production of high alpha-cellulose pulp from a lignocellulosic feedstock, comprising:

(a) contacting a lignocellulosic feedstock with a fluid comprising a water and, optionally, an alcohol, to form a reaction mixture at a temperature in the range of between about 150° C. to about 250° C., or between about 175° C. to about 200° C., or between about 125° C. to about 275° C., and a pressure in the range of between about 200 psi to about 1500 psi, or between about 500 psi to 2000 psi, or between about 400 psi to 1000 psi, for a time period; thereby generating a reaction slurry comprising at least a cellulose product, the cellulose product having an alpha number in the range of between about 50 and 90, or an alpha number of about 45, 50, 55, 60, 65, 70, 75, 80, 85, 90, 95 or higher;

(b) recovering the cellulose product, or cellulose-comprising product, from the reaction slurry; and (c) contacting the cellulose product or cellulose-comprising product with a caustic solution having a pH in the range of between about pH 10 and 14, or about pH 9, 10, 11, 12, 13, 14 or 14.5; thereby increasing the alpha number of the cellulose product to between about 92 and 99 alpha, or an alpha number of about 90, 91, 92, 93, 94, 95, 96, 97, 98, 99 or 99.5.

In alternative embodiments provided herein are methods or industrial processes for the production of an alpha-cellulose pulp comprising:

(a) providing a lignocellulosic feedstock; and (b) contacting the lignocellulosic feedstock with a fluid comprising a water and, optionally, an alcohol, to form a reaction mixture at a temperature in the range of between about 150° C. to about 250° C. and a pressure in the range of between about 200 psi to about 1500 psi, for a time period sufficient to generate a reaction slurry comprising at least one cellulose product having an alpha number in the range of between about 80 and 90.

In alternative embodiments, methods or industrial processes as provided herein further comprise recovering the cellulose product from the reaction slurry.

In alternative embodiments, methods or industrial processes as provided herein further comprise contacting the recovered cellulose product with a caustic solution having a pH in the range of between about 10 and 14, for a time sufficient to increase the alpha number of the cellulose product to between about 92 and 99 alpha, wherein optionally the contacting of the cellulose product with the caustic solution generates a solubilized hemicellulose that is separated or extracted from the caustic material, optionally by a nanofiltration or equivalent process, and optionally the separation or extraction process comprises a "cold-caustic" extraction process, and optionally the separation or extraction process comprises use of a solvent (e.g., an extraction solvent) having a reduced polarity, wherein optionally the polarity of the solvent has been reduced by use of a supercritical fluid, wherein optionally the supercritical fluid comprises an alcohol (optionally ethanol, methanol, isopropanol, butanol, polyols, propylene glycol, ethylene glycol or combinations thereof), or optionally the supercritical fluid that can reduce the polarity of the solvent can comprise: carbon dioxide, ammonia, ethane, ethylene, acetone, propane, propylene, nitrous oxide and butane and combination thereof; or, carbon dioxide and one or more co-solvents.

In alternative embodiments, for the methods or industrial processes as provided herein, the lignocellulosic feedstock comprises a low alpha-cellulose kraft pulp, optionally a kraft pulp with alpha cellulose content in the range of between about 84% to about 88% alpha-cellulose. The lignocellulosic feedstock can comprise: a wood, optionally a hardwood or a softwood; a cotton fiber; a grass or any plant of the genus *Miscanthus*; a straw; a cane; an agricultural or a forestry residue(s), optionally a corn cob or a corn husk, or a sugar cane bagasse; a residue generated in an oil palm production or a palm tree (or any plant of the family Arecaceae) harvesting or production process, optionally a palm mesocarp fiber; a palm frond or a palm trunk; a rice husk; a rice bran; or, any combination thereof.

In alternative embodiments, the lignocellulosic biomass is processed to generate multiple product streams comprising at least: a product stream comprising a pulp product or a product substantially or primarily of cellulose; a product stream comprising a sugar product or a product substantially or primarily of a pentose sugar or plurality of pentose sugars (having been generated from the hemicellulose portion of the lignocellulose material); and, a product stream comprising a lignin product or a product substantially or primarily of a lignin.

In alternative embodiments, the lignocellulosic biomass is first size-reduced to a suitable size for handling, optionally, the biomass is size-reduced to less than about 5% of the diameter of the smallest pipe within a processing system, and optionally the feedstock is passed through a sieve to ensure that the "fines", or very small particles with low degree of polymerization, are substantially separated from the feedstock prior to reacting the feedstock.

In alternative embodiments, the lignocellulosic biomass, or a size-reduced feedstock, is transferred to a pre-steaming unit or any reaction vessel comprising low-pressure steam, optionally at between about 10 psig to about 50 psig steam (optionally at about 5, 10, 15, 20, 25, 30, 35, 40, 45, 50 or 55 psig), and the pressured steam is injected into a reaction vessel, wherein the steam increases the density of the lignocellulosic biomass or the size-reduced feedstock by removing air from the biomass; and optionally after the pre-steaming process the size-reduced, presteamed lignocellulosic biomass, or the size-reduced feedstock, is transferred to a high-pressure pump for introduction into a digestion reactor, and optionally the lignocellulosic biomass or the size-reduced feedstock stream is diluted using a solvent, optionally an alcohol and/or water, to generate a flowable slurry for ease of transporting.

In alternative embodiments, the size-reduced lignocellulosic biomass or feedstock, or pre-steamed and size-reduced feedstock, is transferred to a suitable reaction vessel, or a digester or digestion reactor, for digestion, and optionally the transfer is via a high-pressure or other suitable pump, and mixed with a solvent, optionally an alcohol (optionally ethanol or methanol) or a mixture of an alcohol and water, and optionally the alcohol is between about 30% to 70% of the solvent (or about 25%, 30%, 35%, 40%, 45%, 50%, 55%, 60%, 65%, 70%, or 75% of the solvent) by weight and water makes up the remaining weight of the solvent.

In alternative embodiments, the reaction vessel, digester or digestion reactor is operated in a continuous fashion and/or the solvent contacts the biomass or feedstock either co-currently or counter-currently.

In alternative embodiments, the ratio of solvent-to-biomass in the reaction vessel, digester or digestion reactor is between about 4:1 to about 10:1 by weight, and optionally the reaction vessel is heated to a temperature or between about 180° C. to about 220° C., or at about 200° C., and optionally maintained at a pressure between about 300-700 psig, optionally about 500 psig, for a time that is sufficient to allow for lignin and hemicellulose to be cleaved from cellulose polymers in the lignocellulosic biomass or feedstock, and optionally the residence time of the digestion reactor is between about 30 min to about 120 minutes, or between about 50 min to about 100 min, or between about 70 min to about 80 min, or about 75 minutes (min).

In alternative embodiments, the sized-reduced, or sized-reduced and presteamed lignocellulosic biomass or feedstock, is subjected to an auto-hydrolysis step prior to the digestion step, wherein the auto-hydrolysis step comprises mixing the sized-reduced, or sized-reduced and presteamed lignocellulosic biomass or feedstock with water in a ration of between about 4:1 to about 10:1 water-to-biomass by weight, and heating the mixture to between about 150-180° C. in a pressurized vessel, and maintaining at a pressure of between about 200-700 psig for a residence time of between about 20 min to about 120 min, or between about 50 min to about 100 min, or between about 70 min to about 80 minutes, or for about 75 min, wherein the auto-hydrolysis causes the hemicellulose in the feedstock to substantially cleave from the lignin and cellulose, thereby generating a relatively or substantially pure oligosaccharide product, optionally comprising primarily C5 (pentose) sugars, which optionally can be recovered prior to the digestion reaction, and optionally the auto-hydrolysis increases the porosity of the feedstock for the digestion.

In alternative embodiments: a weak base is added to the digestion reaction mixture to prevent the pH from dropping below about pH 3.8; or, a weak acid is added to the digestion reaction to facilitate cleavage of the hemicellulose during the digestion reaction, and optionally the acid or base are added in an amount up to about 5% by weight of the biomass in the reaction mixture.

In alternative embodiments, an aqueous phase comprising a hemicellulose (and/or xylo-oligosaccharides (XOS)) and a lignin are separated from a cellulose or a "pulp" product, and optionally the aqueous phase is sent to a sugar/lignin isolation unit wherein the hemicellulose (and/or xylo-oligosaccharides (XOS)) are converted to fermentable sugars and separated from the lignin, and optionally the pulp product is further processed.

In alternative embodiments, the separated hemicellulose and lignin (or the aqueous phase solution or mixture comprising the separated hemicellulose and lignin), and/or any long-chain polysaccharide in the reaction mixture, are converted or hydrolyzed to a sugar, or a fermentable sugar or sugars, and optionally lignin is separated from the fermentable sugar(s), and optionally the separated hemicellulose and lignin is transferred to a reaction vessel or a "flash unit" wherein the temperature is decreased from the temperature of the digestion reaction vessel to between about 140° C. to about 150° C., or between about 130° C. to about 155° C., and optionally adjusting or changing the pH of the separated hemicellulose and lignin or reaction mixture to between about pH 1.0 to about pH 1.5 (or sufficiently acid to hydrolyze long-chain hemicellulose oligosaccharides), optionally with the addition of an acid, optionally a sulfuric acid, thereby hydrolyzing long-chain hemicellulose oligosaccharides or xylo-oligosaccharides (XOS), or optionally adding enzymes (e.g., hemicellulases, xylanases such as endo-1,4-β-xylanases) to hydrolyze the hemicellulose, thereby hydrolyzing long-chain hemicellulose oligosaccharides or xylo-oligosaccharides (XOS), wherein optionally the hydrolyzed long-chain hemicellulose oligosaccharides or xylo-oligosaccharides (XOS) generate primarily short-chain C5 (pentose) sugars, optionally pentose monosaccharides or long-chain sugars or disaccharides.

In alternative embodiments, the long-chain hemicellulose oligosaccharide hydrolysis reaction, or XOS hydrolysis, comprises a batch or a continuous process in a reaction vessel, optionally a continuously stirred tank reactor, continuous pipe-type (plug-flow) reactor or equivalent thereof.

In alternative embodiments, following the long-chain hemicellulose oligosaccharide hydrolysis reaction, or XOS hydrolysis reaction, a resulting hydrolysate stream is subjected to a separation process or steps wherein acid-insoluble lignin is separated from the sugars in the hydrolysate stream to generate a substantially pure or substantially free of lignin hydrolysate stream comprising the sugars, and optionally the resulting hydrolysate stream is subjected to an ion-exchange step to recover any acids prior to subsequent downstream processing step, and optionally treating a filtrate stream of the ion-exchange step with a base (optionally calcium carbonate, calcium bicarbonate, calcium hydroxide, magnesium hydroxide, and equivalents thereof), thereby converting any acids present in the filtrate to insoluble salts which optionally then precipitate out of solution and can be recovered (optionally by filtration centrifugation, clarification and equivalents thereof) prior to downstream processing steps.

In alternative embodiments, the acid-insoluble lignin, having been separated from the hydrolysate stream, is subjected to a water-washing and a drying step, and optionally the water-washing step recovers an entrained hydrolysate liquor, and optionally the washed lignin is dried to below about 20% liquid content, and then optionally burned in a boiler for heat and/or power generation, which optionally can be recycled in the process or used in a co-located facility, optionally a palm oil production facility or equivalent.

In alternative embodiments, the converted or hydrolyzed sugar or fermentable sugar or sugars are separated, optionally separated as a filtrate or a filtrate stream, and the separated sugars or filtrate are pH adjusted to neutralize any organic acids present (optionally generating a pH neutralized solution or mixture), thus rendering them nonvolatile and simplifying downstream recovery and separation processes; wherein optionally the acid is neutralized by adding a base, optionally an ammonium hydroxide, and optionally increasing the pH to between about pH 5 to pH 7, or between about pH 4.5 to pH 7.5, optionally about pH 4.5, 5, 5.5, 6, 6.5, 7 or 7.5, optionally the base reacts in with the organic acids to generate salts of organic acids, optionally ammonium salts of organic acids if ammonium hydroxide is the selected base.

In alternative embodiments, processes or methods provided herein comprise or further comprise separating an acid-insoluble lignin from the pH neutralized solution or mixture, or filtrate or a filtrate stream.

In alternative embodiments, processes or methods provided herein comprise or further comprise transferring the acid-neutralized solution, mixture of filtrate or filtrate stream to an alcohol/furfural recovery unit wherein the alcohol in the solution, mixture of filtrate or filtrate stream and any furfurals generated in any preceding processing step or steps are separated from the neutralized solution, mixture of filtrate or filtrate stream via a distillation; and optionally the distillation comprises a multistage distillation column wherein the alcohol evaporates and is recovered at the top of the column, and the furfurals are recovered via a side stream.

In alternative embodiments, the recovered furfural stream is purified, optionally by allowing the furfural stream to cool and then decanting the cooled stream and further purifying it in a separate distillation column; and optionally a recovered alcohol is recycled. In alternative embodiments, processes or methods provided herein comprise or further comprise recovering from the bottoms of the distillation columns C5 sugars and low molecular weight lignin not removed in previous lignin separation steps, and optionally transferring the sugars to a downstream processing unit to generate a concentrated sugar, optionally a C5 sugar, product.

In alternative embodiments, processes or methods provided herein comprise or further comprise washing cellulose fibers generated in the digestion step to remove any non-cellulose impurities, and optionally beating or fluffing the washed cellulose (the washed cellulose is "fluffed" or beaten to increase the surface area of the washed cellulose) to generate a "de-fiberized" cellulose pulp; and optionally the beating or fluffing of the washed cellulose comprises use of a PFI-type mill, and/or by passing the washed cellulose through a refining disc; and optionally removing impurities or shives (incompletely ground fiber bundles) from the "de-fiberized" cellulose pulp.

In alternative embodiments, processes or methods provided herein comprise or further comprise bleaching the "de-fiberized" cellulose pulp, optionally comprising a chelation step to reduce the mineral content, wherein the bleaching comprises a photo-catalytic oxidation or equivalent thereof.

In alternative embodiments, processes or methods provided herein comprise or further comprise subjecting the "de-fiberized" cellulose pulp to a hot or cold caustic extraction step to remove any remaining hemicellulose, and optionally to increase the alpha-cellulose content to about 95% or more, wherein optionally the hot or cold caustic extraction step is done either before and/or after the bleaching step, or the bleaching step including the chelation step.

In alternative embodiments, processes or methods provided herein comprise or further comprise extracting and/or isolating a lignin from the hydrolyzed, separated or extracted or solubilized hemicellulose by a process comprising use of a supercritical fluid, wherein optionally the supercritical fluid comprises a supercritical alcohol, and optionally the supercritical alcohol is or comprises: an ethanol, a methanol, an isopropanol, a butanol, a polyol, a propylene glycol, an ethylene glycol or a combination thereof. In alternative embodiments, the supercritical fluid is or comprises: a carbon dioxide, an ammonia, an ethane, an ethylene, an acetone, a propane, a propylene, a nitrous oxide, a butane or any combination thereof; or, carbon dioxide and one or more co-solvents.

In alternative embodiments, provided herein are methods or industrial processes for the production of high alpha-cellulose pulp from a lignocellulosic feedstock, comprising all or a subset of steps of the processes as set forth in FIG. 1, FIG. 2 or FIG. 3.

In alternative embodiments, provided herein are systems, or industrial processes, for generating a high-value pulp product and a sugar product from low-value lignocellulosic biomass comprising:

(a) at least two facilities generating a lignocellulosic biomass comprising cellulose, lignin, and hemicellulose;

(b) a cellulose fiber and sugar production facility co-located (e.g., adjacent to; operationally connected to) with each of the at least two biomass-generating facilities;

wherein the biomass generated at each of the at least two biomass generating facilities is processed to generate a crude pulp product with an alpha cellulose number of between about 50 and 90 and a sugar product comprising primarily C5 sugars from hemicellulose in the biomass; and (c) a cellulose upgrading facility approximately centrally located (e.g., approximately equidistant from each of the at least two cellulose fiber and sugar production facilities) to each of the cellulose fiber and sugar production facilities;

wherein the crude pulp product generated at each of the cellulose fiber and sugar production facilities is processed to generate a high-value pulp product, optionally a specialty-grade or dissolving-grade pulp with an alpha cellulose 90, 91, 92, 93, 94, 95, 96, 97, 98, or 99 or higher, or a specialty-grade or dissolving-grade pulp with an alpha cellulose between about 85 to 99.5, or between about 90 to 99.

The details of one or more embodiments of the invention are set forth in the accompanying drawings and the description below. Other features, objects, and advantages of the invention will be apparent from the description and drawings, and from the claims.

All publications, patents, patent applications cited herein are hereby expressly incorporated by reference for all purposes.

Figure 1:
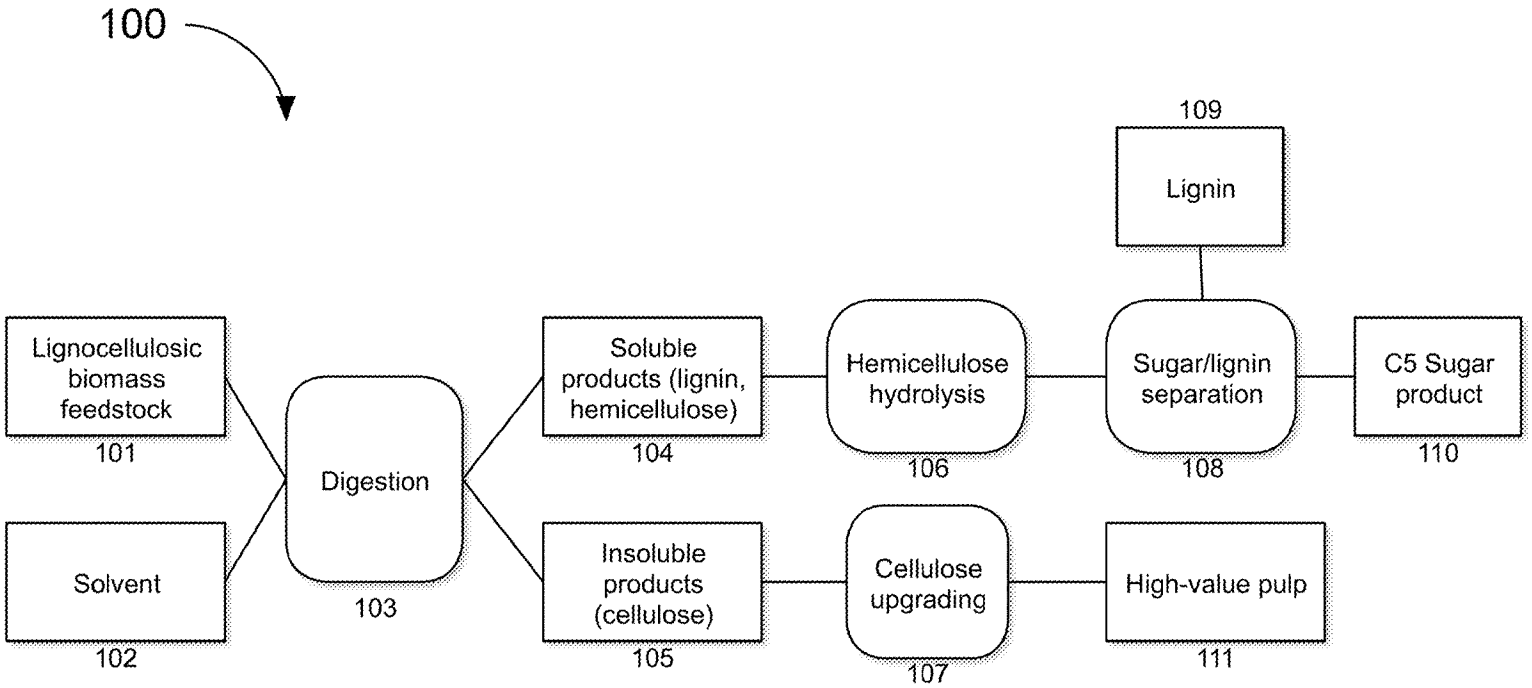
FIG. 1 is a schematic diagram of an exemplary method as provided herein comprising extracting lignin, hemicellulose, and cellulose, and treating and upgrading each, as described below, from biomass feedstocks comprising lignocellulose.

Reference will now be made in detail to various exemplary embodiments of the invention. The following detailed description is provided to give the reader a better understanding of certain details of aspects and embodiments of the invention, and should not be interpreted as a limitation on the scope of the invention.

DETAILED DESCRIPTION OF THE INVENTION

In alternative embodiments, provided herein are methods and industrial processes for the production of high purity, or "dissolving"-grade pulp, suitable for use in the production of a variety end-products and/or chemical intermediates e.g., without limitation, rayon, cellulose acetate, cellophane, pharmaceutical intermediates, and the like. In alternative embodiments, provided herein are methods for producing high purity pulp with an alpha-cellulose content in the range of between about 90 to 98 alpha, without consuming large quantities of toxic or harsh chemicals, and without the use of extreme processing conditions e.g. high temperatures and pressures, thereby allowing for the use of conventional equipment and widely available industrial materials. Further, provided herein are methods and industrial processes for producing high purity pulp from non-conventional feedstocks, e.g. agricultural and forest residues.

As used herein, the term "feedstock" is used to describe the starting material in the pulp production process. The feedstock as provided herein can be any material comprising cellulose fibers, derived from any source. Exemplary fibers include, without limitation, lignocellulosic fibers such as those derived from wood, e.g. hardwoods or softwoods, as well as non-woody fibers comprising cellulose e.g. cotton fibers, various grasses or any plant of the genus *Miscanthus*, straws, canes and the like, agricultural residues such as corn cobs and husks, sugar cane bagasse, residues generated in the oil palm production process e.g. palm mesocarp fibers, palm fronds, or palm trunks, rice husks, rice bran, or any combination thereof. The feedstock provided herein can also be pre-processed, meaning that it has already undergone some amount of treatment to remove a portion of the non-cellulose portion of the feedstock (e.g. hemicellulose and/or lignin). An example of a pre-treated feedstock suitable for use in the processes provided herein is a low alpha-cellulose kraft pulp, e.g. a kraft pulp with alpha cellulose content in the range of about 84% to about 88% alpha-cellulose.

The feedstock can be un-extracted, meaning it has not been purified to remove certain components, e.g. water, lipids, proteins, carbohydrates, or combinations thereof. In an exemplary embodiment, the feedstock is mesocarp fiber from palm fruits, said fruits having been pressed to extract the majority of the lipids contained therein. The mesocarp fibers can contain, for example, from about 0 wt % lipids to about 15 wt % lipids, e.g. 5% wt lipids, and about 50 wt % to about 99 wt % lignocellulosic material, e.g. 90 wt % lignocellulosic material, as well as other components in smaller amounts. The feedstock can comprise other components having been grown by a source other than the feedstock e.g. shells, husks, or other materials. The feedstock can be dried or partially dried to remove a portion of the water prior to reaction. The feedstock can be sized-reduced prior to reaction, meaning that it has been broken into smaller portions, thereby increasing the surface area available for reaction.

As used herein, in alternative embodiments, the term "lignocellulose" or any derivative thereof e.g. "lignocellulosic", etc., refers to any plant fibers comprising carbohydrate polymers, e.g. cellulose and hemicellulose, bound together in a macro-structure with lignin.

In alternative embodiments, provided herein are methods for the generation of high-purity pulp comprising a first cellulose-extraction step (referred to herein as the "extraction" step), followed by a cellulose-upgrading step. In alternative embodiments, the extraction step comprises contacting a lignocellulosic feedstock with a fluid in a "supercritical state", optionally a fluid in a "supercritical state" is a fluid that is at, near (substantially close to), or above the critical point of at least one component of the fluid. During the extraction step, the supercritical, near-critical, or subcritical fluid exhibits enhanced solvolysis and penetration activity and serves to cleave the lignocellulosic material to generate a cellulose product of relatively low-purity, e.g. about 80% to about 90% alpha-cellulose.

In alternative embodiments, provided are methods and industrial processes comprising use of a supercritical fluid (e.g., an alcohol) to reduce the polarity of the extraction solvent. For example, supercritical alcohols that can be used include or comprise: ethanol, methanol, isopropanol, butanol, polyols, propylene glycol, ethylene glycol or combinations thereof. In alternative embodiments, supercritical fluids that can reduce the polarity of the extraction solvent can comprise: carbon dioxide, ammonia, ethane, ethylene, acetone, propane, propylene, nitrous oxide and butane and combination thereof; or, carbon dioxide and one or more co-solvents. The decrease in polarity of the solvent increases the solubility of non-polar components of the lignocellulosic biomass, e.g. lignin by rendering them more lipophilic. The increased solubility of the non-polar components in the feedstock increases overall efficiency of the process.

In alternative embodiments, a low-purity product is then subjected to an upgrading step wherein it is further extracted to remove all or a portion of the remaining non-cellulose components, thereby generating a pulp product of high-purity suitable for sale and use as a "dissolving"-grade pulp product.

The extraction step can comprise, for example, a "cold-caustic" extraction, wherein the all or a portion of the hemicellulose in the extracted product is solubilized by contacting it with a solution comprising a strong caustic e.g. sodium hydroxide.

In alternative embodiments, provided herein are processes further comprising a caustic-recovery step wherein the solubilized hemicellulose from the upgrading step is separated from the caustic material by means known in the art e.g. nanofiltration, and the caustic is recycled for use in the extraction process.

Biomass Fractionation and Cellulose Extraction

In alternative embodiments, the biomass feedstock is fractionated to cellulose and hemicellulose, and cellulose is recovered from a product slurry in a first reaction stage. In alternative embodiments, for fractionating the biomass feedstock, the feedstock is contacted with a fluid in a supercritical or near-critical state. In alternative embodiments, the supercritical fluid state is a state where the temperature and pressure of the fluid above its critical point where distinct liquid and gas phases do not exist; the supercritical fluid can effuse through solids like a gas or dissolve materials like a liquid. For example, in alternative embodiments, provided are methods comprising contacting a biomass feedstock, e.g., a lignocellulosic feedstock, with a supercritical fluid (e.g., comprising a water, or a water and an alcohol), where the supercritical fluid state comprises a temperature in the range of between about 150° C. to about 250° C. and a pressure in the range of between about 200 psi to about 1000 psi to about 1500 psi. In alternative embodiments this supercritical fluid state is maintained for a time period sufficient to generate a reaction slurry comprising at least one cellulose product having an alpha number in the range of between about 80 and 90.

In certain embodiments, the fluid and the feedstock are combined prior to entering the reactor to form a slurry which is fed to the reactor as a reaction mixture. In other embodiments, the feedstock and fluid are fed to the reactor in separate streams and form a reaction mixture.

In alternative embodiments, in order to achieve the desired solvolysis (e.g., hydrolysis, alcoholysis) activity of the fluid in the reaction mixture, the mixture is heated and pressurized to a point (e.g., a temperature in the range of between about 150° C. to about 250° C. and a pressure in the range of between about 200 psi to about 1000 psi to about 1500 psi) that is at, near or above the supercritical points of one or more of the components in the fluid. When the desired reaction conditions are achieved, the lignocellulosic feedstock is cleaved into its primary components, e.g. cellulose, hemicellulose, and lignin and a product slurry is formed comprising said components. During the reaction, all or a portion of the hemicellulose present in the feedstock is cleaved from the lignocellulosic structure, some or all of which be further hydrolyzed into pentose and/or hexose sugars in the same reaction step. The resulting product slurry comprises a soluble fraction, comprising the hemicellulose and/or hemicellulose derivatives and lignin, and an insoluble fraction, comprising primarily solid cellulose.

In alternative embodiments, provided are methods and industrial processes comprising use of a supercritical fluid (e.g., an alcohol) for extraction and/or isolation of lignin from hemicellulose. For example, supercritical alcohols that can be used include or comprise: ethanol, methanol, isopropanol, butanol, polyols, propylene glycol, ethylene glycol or combinations thereof. In alternative embodiments, supercritical fluids that can reduce the polarity of the extraction solvent can comprise: carbon dioxide, ammonia, ethane, ethylene, acetone, propane, propylene, nitrous oxide and butane and combination thereof or, carbon dioxide and one or more co-solvents.

The product slurry is then sent to a liquid/solid separation system wherein the insoluble portion comprising the cellulose is removed from the product slurry and sent to the cellulose upgrading system. The hemicellulose and/or derivatives thereof can be recovered from the product slurry through means known in the art for use in various industrial processes.

In alternative embodiments, the fluid comprises near-critical or sub-critical water. Temperatures and pressures for near-critical and sub-critical water are known in the art. Near-critical water can have a temperature, for example, of about 300° C., and a pressure of about 3200 psi. Sub-critical water can have a temperature, for example, of less than about 300° C., e.g. 275° C. and a pressure of about 3200 psi.

In alternative embodiments, provided are methods and industrial processes comprising use of a supercritical fluid (e.g., a temperature in the range of between about 150° C. to about 250° C. and a pressure in the range of between about 200 psi to about 1000 psi to about 1500 psi) for extraction and/or isolation of lignin from hemicellulose. In alternative embodiments the supercritical fluid is, or comprises, a supercritical alcohol, including for example: ethanol, methanol, isopropanol, butanol, polyols, propylene glycol, ethylene glycol or combinations thereof. In alternative embodiments, the fluid further comprises a supercritical alcohol. In alternative embodiments, the alcohol contains between 1 and 5 carbons, e.g. methanol, ethanol, propanol, butanol, isopropyl alcohol, sec-butanol, t-butanol, or a combination thereof. In various other embodiments, conditions may be such that a higher alcohol containing more than 5 carbons would be preferred. For purposes of this discussion, methanol is used as the alcohol, however those skilled in the art would understand that other alcohols can be used.

The alcohol can be, for example, in the range of between about 5 wt % to about 95 wt % of the fluid, for example, 40 wt % to about 60 wt %. The amount of water can be, for example, in the range of between about 5 wt % to about 95 wt % of the fluid, for example, about 60 wt % to about 40 wt %.

In alternative embodiments the supercritical fluid is, or comprises, carbon dioxide, ammonia, ethane, ethylene, acetone, propane, propylene, nitrous oxide and butane and combination thereof. In alternative embodiments the supercritical fluid is, or comprises, carbon dioxide and one or more co-solvents.

The temperature of the "supercritical" reaction can be, for example, in the range of between about 150° C. to about 250° C. In alternative embodiments, the pressure of the reactor is slightly in excess of the vapor pressure of the alcohol of choice at the selected operating temperature, e.g. 20 psi over the vapor pressure. Maintaining the pressure of the reaction vessel above the vapor pressure of the alcohol prevents the alcohol from boiling and allows it to reach a supercritical state. The pressure for the reaction can be in the range of between about 200 psi to about 1500 psi, for example, between about 400 psi and about 800 psi, or about 500 psi to about 600 psi.

In alternative embodiments, the reaction is carried out for a period in the range of about 1 minute to about 240 minutes, for example, in the range of between about 10 minutes to about 200 minutes, about 60 minutes to about 180 minutes, or about 120 minutes to about 180 minutes. The reaction time will depend on the selected reaction system and operating conditions and is generally sufficient to allow for the conversion of the reaction mixture to the desirable product mixture without allowing for the production undesirable reaction products. At higher temperatures and pressures, the reaction time can be reduced.

In alternative embodiments, in the foregoing reaction conditions, the fluid acts as a solvent on the lignocellulosic feedstock and, via hydrolysis, alcoholysis, or a combination thereof, the cellulose and hemicellulose polymers are extracted from the lignocellulose structure macro-structure of the feedstock. During the reaction, conditions are maintained such that the majority of the cellulose polymers are un-reacted, meaning that they are not further cleaved into glucose monomers or other short-chain polysaccharides. This is desirable to allow for the cellulose component to be used as a pulp product. Some or all of the hemicellulose may be further cleaved into xylose monomers, e.g. pentose or pentose derivatives such as alkyl pentoside, during the reaction step.

After the insoluble fraction comprising the cellulose is separated from the product slurry, the lignin, hemicellulose, and any hemicellulose derivatives, if present, remain in the aqueous water or water-alcohol phase of the product slurry. The lignin can be separated from the hemicellulose and/or hemicellulose derivatives by one of several methods known in the art, e.g. evaporation, filtration, centrifugation, or the like. The lignin and hemicellulose and/or hemicellulose derivatives can be recovered and used in various downstream applications and therefore represent co-products of the cellulose product that is the primary product as provided herein.

In alternative embodiments, provided are methods and industrial processes for the production of pulp from lignocellulosic biomass. In alternative embodiments, lignocellulosic biomass is processed to generate multiple valuable product streams including a pulp product comprised primarily of cellulose, a sugar product comprised primarily of pentose sugars having been generating from the hemicellulose portion of the lignocellulose material, and a lignin product. In this way, all three components of lignocellulosic biomass, i.e. cellulose, hemicellulose, and lignin, are separated into individual "product streams", thereby converting a low-value biomass e.g. agricultural or forestry residue, into high-value products.

The feedstock (the biomass selected as the starting material for the process) can be any lignocellulosic material such as, without limitation, agricultural residues, forestry residues, hardwood, softwood, purpose-grown biomass feedstocks e.g. *Miscanthus*, or any other lignocellulosic material. In alternative embodiments, provided herein are methods and industrial processes for generating valuable products from low-value biomass that is otherwise discarded or burned. In alternative embodiments, the feedstock for the process is biomass residue generated during the production of palm oil such as palm trees, branches and/or other residues generated in the palm plantations, empty fruit bunches (EFBs), mesocarp fibers in pressed palm fruits or any combination thereof. Currently, the majority of lignocellulosic material generated during the cultivation of oil palm and the processing of oil palm fruit for oil is either discarded or burned for power generation. This represents a significant opportunity to increase the economic output of existing oil palm operations by converting low-value biomass into valuable products.

The reactor system can be batch or continuous. There are several conventional pressure vessel systems available that will operate in batch and continuous modes and would be suitable for the reactor system used in this stage. In addition, a continuous pipe-type (i.e. plug-flow) reactor can be used to carry out the reaction. A plug flow reactor is a pipe that is maintained at the target pressure and temperature ranges and allows the reaction mixture to pass through the internal volume of the pipe. In such a system, the reaction mixture is sent through the reactor at a constant speed, thereby exposing the reaction mixture to a constant temperature and pressure for a predetermined time. The plug flow reactor system also allows for a continuous process, as material can be fed into the reactor at the same rate at which reaction products exit the vessel.

In alternative embodiments, following extraction, the insoluble portion of the product slurry, comprising primarily cellulose fibers, is separated from the soluble portion comprising the hemicellulose and/or hemicellulose monomers. In alternative embodiments, the separated cellulose product further comprises some amount of hemicellulose that is still bound to the cellulose fibers. The relative amount of cellulose to other products in the separated cellulose portion, as measured by the alpha-cellulose content of the cellulose product, can be, for example, in the range of about 80 to 90 alpha (i.e. 80% to about 90% alpha cellulose), e.g. between about 84 to 88 alpha, or a range comparable to that of kraft pulp.

Cellulose Upgrading

In alternative embodiments, following the biomass fractionation and extraction stage, the cellulose fibers obtained in the fractionation and extraction step are sent to cellulose upgrading process wherein all or a portion of the non-cellulose impurities therein are removed, providing a relatively pure cellulose product with an alpha number in the range of between about 90 to about 98, e.g. 92 to 98 alpha, 92 to 98 alpha, or 96 to 98 alpha. In alternative embodiments, a high alpha-cellulose product is obtained by subjecting the cellulose fibers an alkaline treatment as the process described in U.S. Pat. No. 6,896,810 or 7,854,847, both of which are incorporated by reference herein.

In alternative embodiments, the un-treated cellulose fibers are subjected to an upgrading process comprising containing the fibers with a solution comprising ammonium carbonate. In a first step, the fibers are washed in the ammonium carbonate solution, wherein the relatively high pH of the solution causes all or a portion of the hemicellulose to be fractionated from the cellulose fibers, providing a cellulose product with a higher alpha number than starting material. The wash liquor comprising the hemicellulose can then be heated to convert the ammonium carbonate into ammonium bicarbonate and gaseous ammonia, both of which can be recovered and recompressed to reform the ammonium carbonate. The reformed ammonium carbonate can then be recycled for subsequent reactions with the untreated cellulose fibers. The hemicellulose will be solubilized in the wash liquor and can be separated therefrom using any suitable method known in the art, e.g. filtration, centrifugation, or the like.

By subjecting the fibers to a caustic treatment process, the majority, or all, of the hemicellulose and other non-cellulose components in the un-treated cellulose material are removed, yielding a relatively pure, high-alpha cellulose product that is suitable for use as a "dissolving"-grade pulp. Because the reaction step used to fractionate the biomass and extract the cellulose does not significantly disrupt the structure of the cellulose polymers, the resulting product will have a relatively uniform molecular weight, which is a desirable characteristic in dissolving pulps.

Biomass Handling

In alternative embodiments, the lignocellulosic biomass feedstock is size-reduced to a suitable size for materials handling within the process. In alternative embodiments, the biomass is size-reduced to less than about 5% of the diameter of the smallest pipe within the system. For example, if the internal diameter of the smallest pipe in the system is 1" the biomass would be size-reduced less than about 0.05" prior to entering the system. The feedstock can be size-reduced using any of the methods known in the art e.g. mechanical grinding or chopping. In alternative embodiments, the feedstock is passed through a sieve to ensure that the "fines", i.e. very small particles with low degree of polymerization are separated from the feedstock prior to reacting the feedstock. This ensures that a relatively large particle size is maintained throughout the various stages of the process, thereby preventing the formation of undesirable products e.g. high viscosity sugar products that may inhibit the process flow.

In alternative embodiments, the size-reduced feedstock is the transferred to a pre-steaming unit, e.g. any suitable reaction vessel, wherein low-pressure steam, e.g. between about 10-50 psig steam, e.g. 30 psig steam, is injected into the vessel. The steam serves to increase the density of the feedstock by removing air from the biomass. This is desirable as the increased density allows for a biomass slurry product to settle in the bottom of the reaction vessel. By increasing the density of the biomass, the biomass settles more readily and is easier to separate from the reaction vessel. The residence time for the pre-steaming step can vary but is generally enough time to allow for sufficient air removal from the biomass, e.g. about 30 minutes.

After the steaming process, the size-reduced, pre-steamed biomass transferred to a high-pressure pump for introduction into the digestion reactor. The biomass stream can optionally be diluted using a solvent, e.g., an alcohol and/or water to generate a more flowable slurry for ease of transporting.

Biomass Digestion

In alternative embodiments, the size-reduced, presteamed feedstock is transferred to a suitable reaction vessel, or digester or digestion reactor, via a high-pressure or other suitable pump wherein it is mixed with a solvent, e.g. alcohol or a mixture of alcohol and water. The digester can be operated in a continuous fashion and the solvent can contact the biomass either co-currently or counter-currently.

In alternative embodiments, the solvent is a mixture of water and alcohol, e.g. ethanol or methanol. In alternative embodiments, the alcohol is between 30-70% of the solvent by weight and water makes up the remaining weight of the solvent.

In alternative embodiments, the ratio of solvent-to-biomass in the digestion reactor is between about 4:1 to about 10:1 by weight.

In alternative embodiments, the reaction vessel is heated to a temperature of between about 180-220° C., e.g. about 200° C. and maintained at a pressure between about 300-700 psig, e.g. about 500 psig, for a time that is sufficient to allow for the lignin and hemicellulose to be cleaved from the cellulose polymers in the feedstock. In alternative embodiments, the residence time of the digestion reactor is between about 30-120 minutes, e.g. about 50-100 minutes, about 70-80 minutes, or about 75 minutes.

In alternative embodiments, the sized-reduced and presteamed feedstock can be subjected to an autohydrolysis step prior to the digestion step. In the optional autohydrolysis step, the size-reduced, presteamed biomass is mixed with water in a ration of between about 4:1 to about 10:1 water-to-biomass by weight. The mixture is then heated to between about 150-180° C. in a pressurized vessel and maintained at a pressure of between about 200-700 psig for a residence time of between about 20-120 minutes, e.g. about 50-100 minutes, about 70-80 minutes, or about 75 minutes. In the autohydrolysis step, the reaction conditions cause the hemicellulose in the feedstock to cleave from the lignin and cellulose, thereby generating a relatively pure oligosaccharide product comprising primarily C5 (pentose) sugars that can be recovered prior to the digestion reaction. The autohydrolysis also increases the porosity of the feedstock for the solvent digestion.

Various additives may also be added to the reaction mixture during the digestion stage of the process. In alternative embodiments, a weak base is added to the digestion reaction mixture to prevent the pH from dropping below 3.8, below which long-chain polysaccharides convert to shorter saccharides e.g. mono- and disaccharides and decrease the intrinsic viscosity of the pulp product beyond an acceptable level. The pH of the digestion reaction decreases primarily due to the presence of acetic acid contained in the hemicellulose. In alternative embodiments, a weak acid may be added to the digestion reaction to facilitate cleavage of the hemicellulose during the digestion reaction. The acid or base may be added in an amount up to about 5% by weight of the biomass in the reaction.

Following the digestion reaction, the majority of the lignin and hemicellulose present in the biomass are cleaved off of the cellulose fibers. The cellulose fibers are insoluble in the reaction product mixture and "crash" out of the solution and fall to the bottom of the reaction vessel. The hemicellulose and lignin are soluble in the product mixture and remain in the aqueous phase of the product. The aqueous phase comprising the hemicellulose and lignin can be separated from the cellulose or "pulp" product by any method known in the art. The aqueous phase is then sent to the sugar/lignin isolation unit wherein the hemicellulose is converted to fermentable sugars and separated from the lignin, and the pulp product is sent to the pulp-upgrading step wherein it can be upgraded using various techniques to generate a final pulp product.

Sugar/Lignin Isolation

After the aqueous phase comprising the hemicellulose and lignin is separated from the pulp product following the digestion reaction, it is subjected to a number of processing steps wherein long-chain polysaccharides are converted into fermentable sugars and lignin is separated from the sugars.

In alternative embodiments, the aqueous phase of the digestion product mixture comprising the majority of the hemicellulose and lignin of the original feedstock is transferred to a flash unit wherein the temperature is decreased from the temperature of the digestion reaction vessel to between about 140° C. to 150° C.

In alternative embodiments, the pH of the mixture is then adjusted to between about 1.0-1.5 with the addition of an acid e.g. sulfuric acid. The reduction pH allows for the hydrolysis of the long-chain hemicellulose oligosaccharides i.e. xylo-oligosaccharides (XOS) to generate primarily short-chain C5 (pentose) sugars, i.e. pentose monosaccharides and possible longer-chain sugars e.g. disaccharides. The residence time for the XOS hydrolysis reaction is general sufficient to allow for a full hydrolysis of the XOS into fermentable sugars, e.g. between about 30-60 minutes, e.g. 45 minutes. The XOS hydrolysis reaction can be batch or continuous and be conducted in any suitable reaction vessel known in the art e.g. a continuously stirred tank reactor, continuous pipe-type (plug-flow) reactor, or the like.

In alternative embodiments, following the XOS hydrolysis reaction, the hydrolysate stream is subjected to a separation process, or steps, wherein the lignin is separated from the sugars to generate a substantially pure, i.e. free of lignin, hydrolysate stream comprising the sugars. In alternative embodiments, the separation process is comprised of several stages detailed below but can also be comprised of other lignin-sugar separations known in the art. In alternative embodiments, the product stream generated in the foregoing hydrolysis reaction is subjected to an ion-exchange step to recover any acids prior to subsequent downstream processing steps.

In alternative embodiments, the hydrolysate stream generated during the XOS reaction, comprising lignin and fermentable sugars (primarily C5 sugars) is diluted with water to an amount sufficient to reduce the alcohol content of the hydrolysate stream to between about 10-15% by weight of total liquid content of the hydrolysate stream. The hydrolysate stream is then subjected to turbulence for a period of between about 1-20 minutes, e.g. about 10 minutes, to allow for a more complete physical separation of the lignin and hemicellulose in the hydrolysate stream. The sugars in the hydrolysate stream are soluble in the low pH created by the addition of the acid in the previous step. The majority of lignin compounds are acid insoluble and therefor crash out of the solution and can be separated from the hydrolysate stream using methods known in the art e.g. filtration or centrifugation.

In alternative embodiments, the acid-insoluble lignin, having been separated from the hydrolysate stream can optionally be subjected to a water-washing and drying step. The water-washing step also serves to recover entrained hydrolysate liquor. The washed lignin can be dried to below about 20% liquid content and burned in a boiler for heat and/or power generation that can be recycled in the process or used in a co-located facility, e.g. a palm oil production facility or the like.

In alternative embodiments the filtrate from the above lignin separation step (comprising the sugars) is then sent to a pH adjustment step to neutralize any organic acids present in the filtrate stream, rendering them nonvolatile and simplifying downstream recovery and separation processes. In alternative embodiments, the filtrate stream is neutralized by adding a base, e.g. ammonium hydroxide, to the filtrate in an amount sufficient to increase the pH to between about 5-7, e.g. 6. The base reacts in with the organic acids in the filtrate to generate salts of organic acids, e.g. ammonium salts of organic acids if ammonium hydroxide is the selected base. The neutralization step also allows for any acid-soluble lignin compounds to crash out of solution which are then separated by methods known in the art, as described in the acid-insoluble lignin separation described above. In alternative embodiments, the product stream generated in the foregoing neutralization step is subjected to an ion-exchange step to remove any salts generated during the reaction. The same technique can be used following the low-molecular weight lignin separation step described below.

In alternative embodiments, the filtrate steam is treated with a base e.g. a calcium or magnesium base or salt. The addition of the base or salt serves to convert any acids present in the filtrate to insoluble salts which then precipitate out of solution and can be recovered prior to downstream processing steps. Exemplary bases and salts include calcium carbonate, calcium bicarbonate, calcium hydroxide, magnesium hydroxide, and the like. The present step can be conducted at a temperature in the range of between about 20 and 100° C. for between about 1 and 240 minutes. The generated salts can be separated out of the resulting product stream via known methods e.g. filtration centrifugation, clarification, etc.

In alternative embodiments, the neutralized filtrate stream is transferred to an alcohol/furfural recovery unit wherein the alcohol in the filtrate and any furfurals generated in any of the preceding processing steps are separated from the neutralized filtrate stream via distillation. In alternative embodiments, the neutralized filtrate stream is transferred to a multistage distillation column wherein the alcohol evaporates and is recovered at the top of the column, and the furfurals are recovered via a side stream. The recovered furfural stream can optionally be further purified to generate a saleable furfural product by, for example, allowing the furfural stream to cool and then decanting the cooled stream and further purifying it in a separate distillation column. The recovered alcohol can be recycled and used within the process for subsequent digestion reactions. The bottoms of the distillation column, comprising the primarily water and C5 sugars, as well as a small amount of low molecular weight lignin that was not removed in previous lignin separation steps, are recovered and transferred to downstream processing units to generate a concentrated sugar product.

In alternative embodiments, the bottoms of the alcohol/furfural distillation column are subjected to additional lignin separation steps to remove any low molecular weight lignin that was not recovered in the above lignin separation steps. The process is identical to the lignin separation steps described above and can be repeated until substantially all of the lignin is removed. The resulting sugar stream, comprising the primarily C5 sugars, is then concentrated using any suitable techniques known in the art, e.g. water evaporation. In alternative embodiments, the low-molecular weight lignin separation steps are alternated with the concentration step. These steps are repeated until a substantially pure sugar stream, comprising primarily C5 sugars with a dissolved solids content of between 50-80 wt % is generated. This represents a saleable product and can be used, for example, for fermentation, xylitol production, or discreet sugar isolation.

In alternative embodiments, other methods are used to generate a sugars from the hemicellulose generated in the digestion reaction. In exemplary embodiments, the filtrate stream, wherein the lignin has been separated, is subjected to an enzymatic digestion step wherein enzymes are used to hydrolyze the hemicellulose to generate sugars. In alternative embodiments, the lignin is not separated from aqueous stream generated in the digestion reaction prior to enzymatic hydrolysis.

Pulp Upgrading

In alternative embodiments, the insoluble product generated in the above digestion step, comprising primarily cellulose fibers (the hemicellulose and lignin having been separated and treated separately within the system) can then be subjected to any of a number of upgrading steps to generate a high-value pulp product. In alternative embodiments, the cellulose fibers are first subjected to a water wash to remove any non-cellulose impurities. Following the digestion step, the alpha-cellulose content of the cellulose product is typically in the range of between about 50-80%. In order to be utilized in higher-value pulp products, the alpha-cellulose number must be increased to above 90%, and, depending on the end-use, above about 95%.

In alternative embodiments, the water-washed cellulose product is beaten to increase the surface area, or "fluff" the product, generating a pulp. This can be achieve with known techniques and equipment, such as with a PFI-type mill, and or passed through a refining disc. The resulting "defiberized" pulp can be screened to remove any shives. In alternative embodiments, the defiberized, screened pulp can then be subjected to any number of upgrading steps to generate dissolving or specialty grade pulp.

In alternative embodiments, the defiberized and screened pulp is bleached using conventional pulp bleaching methods known in the art, including a chelation step to reduce the mineral content to an acceptable levels. The resulting product is saleable for use as a "dissolving grade" pulp. In alternative embodiments, the pulp is bleached using photocatalytic oxidation techniques known in art, or any other bleaching technique known in the art.

In alternative embodiments, the defiberized, screened pulp is subjected to a hot or cold caustic extraction step to remove any of the remaining hemicellulose and increase the alpha-cellulose content to about 95% or more, either before or after a bleaching step (including a chelation step). The resulting pulp is saleable for use as a "specialty grade" pulp.

FIG. 1 shows an exemplary embodiment of a simplified process 100 as provided herein. A feedstock comprising lignocellulosic biomass 101 and a solvent 102 are combined in a digestion reaction vessel 103 wherein they are allowed to react. The reaction generates an aqueous product stream 104 comprising the soluble products generated in the reaction, primarily lignin and hemicellulose, and a slurry 105 comprising the insoluble products generated in the reaction, primarily cellulose fibers.

The aqueous product stream 104 is then subjected to a hemicellulose hydrolysis step wherein the pH of the aqueous product 104 is reduced sufficiently low to allow for the hydrolysis of the hemicellulose polymers, thereby generating short-chain sugars, primarily monomeric C5 sugars. The hydrolysate product generated in the hydrolysis reaction is then subjected to a sugar/lignin separation step 108 wherein the lignin 109 is separated from the hydrolysate product stream. The resulting filtrate stream comprising the sugars is then subjected to various water removal and optional upgrading steps to generate a sugar product 110 (comprising primarily C5 sugars) suitable for use in a variety of industrial applications.

The slurry comprising the cellulose fibers 105 is then upgraded 107 to generate a high-value pulp 111 e.g. a specialty-grade or a dissolving-grade pulp.

Figure 2:
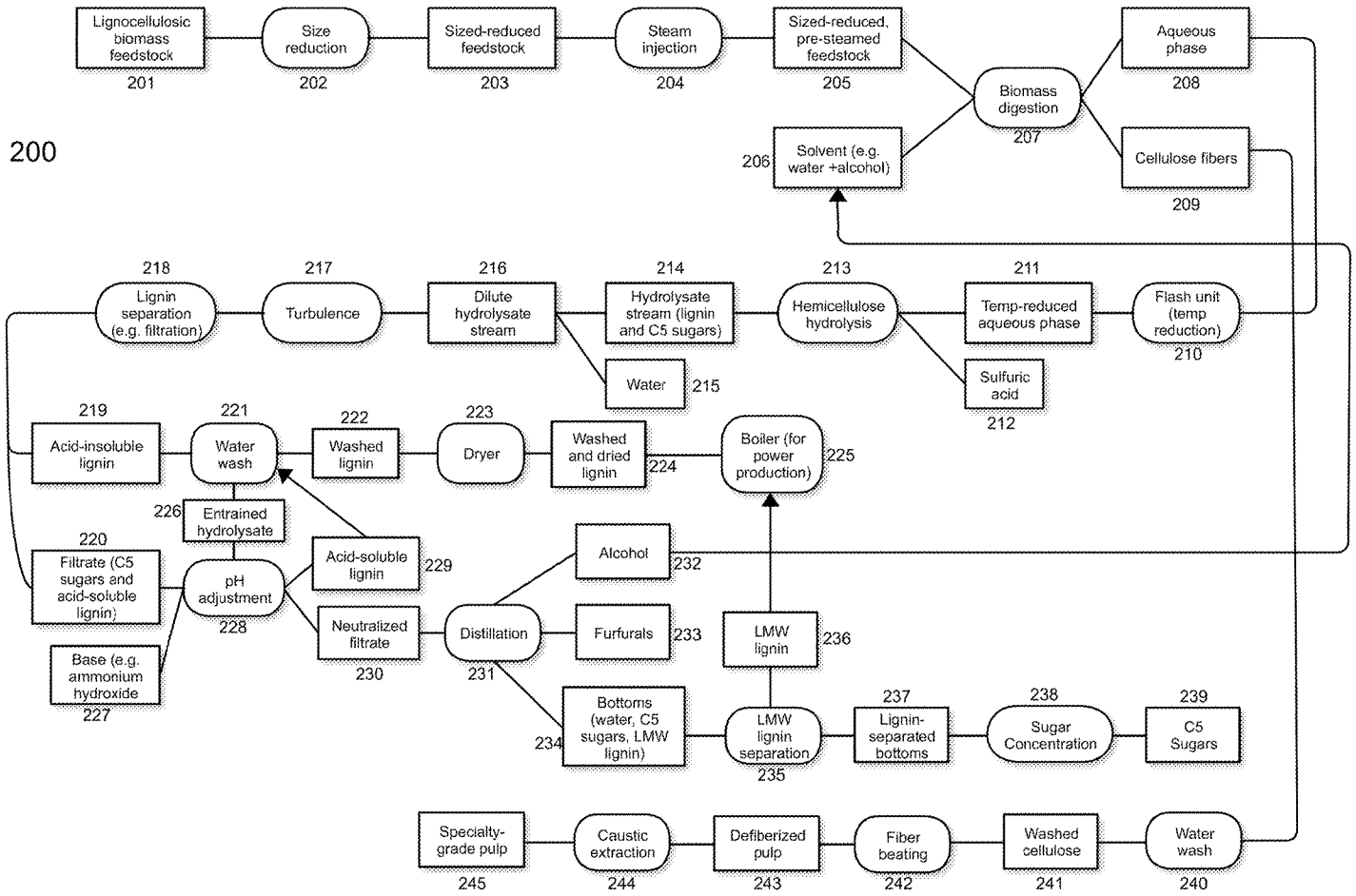
FIG. 2 is a detailed schematic diagram of an exemplary method as provided herein comprising extracting lignin, hemicellulose, and cellulose, and treating and upgrading each, as described below, from biomass feedstocks comprising lignocellulose.

FIG. 2 shows an exemplary embodiment of a process 200 as provided herein. A feedstock comprising lignocellulosic biomass 201 is subjected to a size-reduction step 202, wherein the feedstock is reduced to a particle size of less than about 5% of the diameter of the smallest pipe in the system. The size-reduced feedstock 203 is then subjected to a steam injection step 204 wherein steam pressurized to 30 psig is injected into a vessel comprising the size-reduced biomass feedstock. The steam increases the density of the feedstock by removing air from the biomass and allows for easier handling as the denser material more readily settles at the bottom of downstream reaction vessels. The sized-reduced, pre-steamed biomass 205 is then transferred to a digestion reaction vessel 207 wherein it is mixed with a solvent 206 comprising methanol and water. The amount of solvent 206 added to the digestion reaction vessel is approximately 5:1 by weight of the amount of feedstock in the reaction vessel. The solvent is comprised of approximately 50% methanol and 50% water by weight. The solvent 206 and sized-reduced, steamed biomass 205 are allowed to react at a temperature of 200° C. a pressure of 500 psig for 75 minutes. The digestion reaction generates an aqueous phase 208 comprising the soluble reaction products, primarily hemicellulose and lignin, and a slurry 209 comprising cellulose fibers. The aqueous phase 208 and the slurry comprising the cellulose fibers 209 are separated via filtration and treated separately to generate multiple products.

The aqueous phase 208 generated in the digestion reaction 207 is transferred to a flash unit wherein the heat of the product 208 is reduced to approximately 145° C. The temperature-reduced aqueous phase 211 is then mixed with sulfuric acid 212 in an amount that is sufficient to reduce the pH of the aqueous product stream 208 to about 1.0 and transferred to a reaction vessel 213 wherein it is allowed to react for 45 minutes. The resulting hydrolysate stream 214 comprises hydrolyzed sugars generated from the hemicellulose oligosaccharides. The hydrolysate stream 214 comprising low- and high-molecular weight lignin and sugars (primarily C5 sugars) is the diluted with water 215 to generate a dilute hydrolysate stream 216. The amount of water added to the hydrolysate stream 208 is sufficient to reduce the total methanol content of the hydrolysate stream 208 to about 12.5% of the total liquid content. The dilute hydrolysate stream 216 is then subjected to mechanical turbulence 217 for approximately 10 minutes to allow for a more complete physical separation of the lignin from the sugars in the dilute hydrolysate stream 216. Due to the low pH of the dilute hydrolysate stream 216, the majority of the acid-insoluble lignin crashes out of the solution and are separated 218 using known methods, e.g. filtration.

The separated acid-insoluble lignin 219 is then subjected to a water-wash to remove any entrained hydrolysate 226. The washed lignin 222 is then dried 223 and the washed and dried lignin 224 is sent to a boiler 225 or other power-generation device or system wherein is burned to provide energy and/or heat for use in the process 200.

Filtrate 220 from the lignin separation step 218 comprising water, methanol, and hydrolyzed hemicellulose (primarily C5 sugars and possibly some di- and oligosaccharides), as well as any acid-soluble lignin, is then subjected to a pH adjustment step wherein ammonium hydroxide 227 is mixed with the filtrate 220 in a suitable pH adjustment reaction vessel 228. The amount of ammonium hydroxide 227 required for the pH adjustment step depends on the composition of the filtrate 220 but is generally sufficient to increase the pH of the filtrate 220 to about 6. The increase in pH causes the acid-soluble lignin 229 to crash out of solution. The acid-soluble lignin 229 is then recovered via known methods and added to the acid-insoluble lignin 219 in preparation for the water-wash 221 and subsequent lignin-processing steps.

The neutralized filtrate 230 is the transferred to a distillation column 231 wherein it is distilled to separate the methanol 232 which is then recycled and mixed with water to generate the solvent 206. Any furfurals 233 produced in the digestion 207 or hydrolysis 213 reactions are distilled in the same step. The "bottoms" of the distillation column 234 comprising the sugars (primarily C5 sugars), water, and any low-molecular weight lignin that was not removed in previous processing steps is then subjected to a low-molecular weight lignin separation step 235 wherein it is subjected to lignin-separation steps as described above for separating acid-soluble lignin and acid-insoluble lignin. The resulting lignin-separated bottoms 237 comprising the sugars and water are then subjected to a sugar concentration step 238 wherein substantially all of the water in the lignin-separated bottoms 237 is evaporated off, thereby generating a concentrated C5 sugar product suitable for sale and use in a variety of industrial applications, e.g. fermentation.

The slurry 209 comprising the cellulose fibers generated in the digestion reaction 207 is subjected to a water-wash step 240 to remove any non-cellulose impurities. The washed cellulose 241 is then beaten 242 using known methods and equipment to generate a defiberized 243, or "fluff" pulp. The defiberized pulp is then subjected to a caustic extraction treatment 244 to generate a high alpha-cellulose, specialty-grade pulp 245.

System for Upgrading Low-Value Agricultural/Forestry Waste

In alternative embodiments, certain of the foregoing processing and methods can be geographically separate from one another, allowing for the economical production of high-value product streams from biomass sources that have heretofore not been utilized as sources of sugar or pulp products. Conventional pulp production techniques require significant scale and can therefore be prohibitive in certain instances such as when the biomass source is not available in large quantities or when infrastructure is insufficient to economically transport large amounts of dry, very low-energy density biomass.

Provided herein are processes that can address the above deficiencies in the art by, for example, locating a digestion reactor as described above at a location near a given lignocellulosic biomass source and generating a low-grade pulp product, e.g. an unbleached pulp with an alpha-cellulose content in the range of about 50-80%, and an unpurified hydrolysate stream comprising hemicellulose and lignin, and then further processing the low-grade pulp and hydrolysate streams and a central location (where multiple such product streams are transported), thereby achieving economics of scale that enable the production of high-value products from low-value lignocellulosic biomass.

The foregoing system can be arranged in a "hub-and-spoke" system wherein lignocellulosic biomass is processed into intermediate product streams at the "spokes", and the intermediate product streams are further processed at larger scale into high-value product streams at the "hub." As an illustrative example, lignocellulosic residues generated at oil palm mills, e.g. empty fruit bunches, mesocarp fibers, or a combination of materials, are processed on-site into low-grade pulp and a hydrolysate stream. The hydrolysate stream can optionally be processed on site to isolate the lignin, which can be burned for heat and power at the mill. The hydrolysate and low-grade pulp streams can then be transported to a location central to several oil palm mills for further upgrading into high-grade pulp and a concentrated sugar product.

Figure 3:
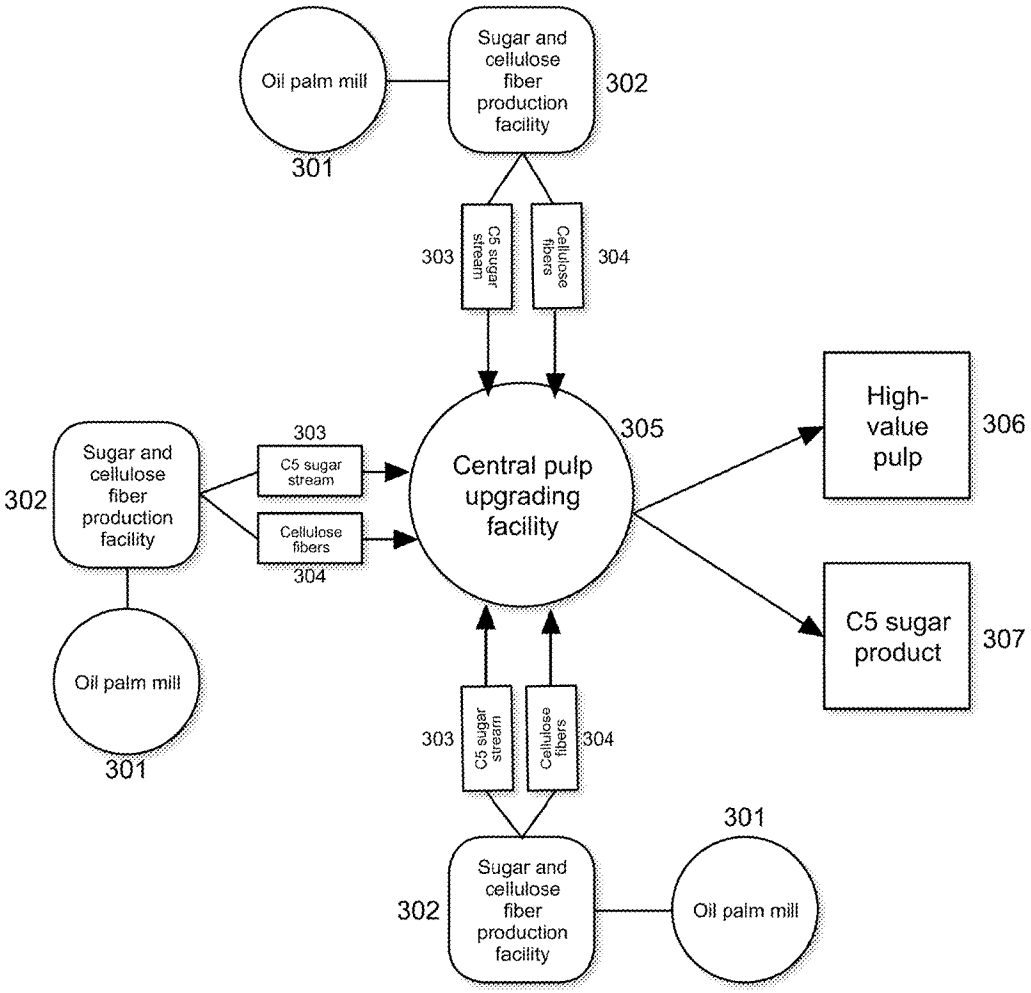
FIG. 3 is a schematic diagram of an exemplary system as provided herein comprising several cellulose fiber and C5 sugar production facilities co-located with oil palm mills, and a centralized pulp-upgrading facility for generating high-value pulp and sugar products, as described below, from tow-value biomass sources generated at the co-located palm mills.

FIG. 3 shows an exemplary pulp production system 300 in accordance with an embodiment as provided herein. The exemplary system 300, includes 3 palm oil mills 301. At each mill 301, multiple lignocellulosic biomass sources are generated as by-products of oil-processing including empty fruit bunches, palm tree trunks, branches, leaves, and the like, mesocarp fibers in the pressed fruits used to generate oil, palm kernel cake, and others. These biomass sources can be combined or handled separately as feedstocks for the sugar and cellulose fiber production facilities 302 co-located with each palm mill 301. Each fiber and sugar processing facility 302 generates a concentrated C5 sugar product 303 as described above in various embodiments and a cellulose fiber product 304 as generated in the digestion reaction described about in various embodiments. The sugar products 303 and cellulose fiber products 304 generated at each facility 302 are transferred to a centrally located pulp-upgrading facility 305. The pulp-upgrading facility generates high-value pulp 306 as described above in various embodiments. The high-value pulp 306 and sugar product 307 can then be transferred in larger quantities, enabling economies of scale and generating high-value products from low-value biomass feedstocks that are currently either burned or returned to the field-generating little to now value for the palm mills.

The invention will be further described with reference to the following examples; however, it is to be understood that the invention is not limited to such examples.

EXAMPLES

Example 1: An Exemplary Method for Generating High Alpha Cellulose

Exemplary Protocol:

1. 100 g of dry *Miscanthus* with a size of <2 inch and 1000 g 50 wt % aqueous MeOH were reacted in 1.9 L Parr autoclave for 60 min at 200° C. with 10 psig nitrogen to ensure no boiling of solvent.
   The generated crude pulp was vacuum filtered and washed with 3 BV of tap water to remove solvent. Dry yield crude pulp from Ecosolv digestion: 47% by wt of dry *Miscanthus*.
   Characteristics of the crude pulp were measured as follows:
   Kappa no.: 70
   Intrinsic viscosity: 904 mL/g.
2. The crude, washed pulp was contacted with 10% aq. NaOH at 2:1 wt loading of NaOH to dry pulp for 60 min @ 25° C. in beaker or Erlenmeyer. The resulting product was vacuum filtered and washed with water until pH of filtrate was <8. Results were as follows:
   Mass dissolved due to cold caustic washing: 12%
   Kappa no.: 65
   Intrinsic viscosity: 850 mL/g.
3. The NaOH washed pulp was bleached using sodium chlorite method: 1.5 g dry pulp, 3 g sodium chlorite, and 1000 mL 1% acetic acid solution. Were mixed and allowed to react for 24 hr at 80° C. The resulting product was vacuum filtered and washed until filtrate pH was 6>. Results were as follows:
   Dry yield bleached pulp based on starting dry *Miscanthus:* 35%
   Kappa no.: 1.6
   Intrinsic viscosity—430 mL/g.

A number of embodiments of the invention have been described. Nevertheless, it will be understood that various modifications may be made without departing from the spirit and scope of the invention. Accordingly, other embodiments are within the scope of the following claims.

What is claimed is:

1. A method or industrial process for the production and extraction or separating of at least one high alpha-cellulose pulp product and at least one solubilized hemicellulose product, and at least one lignin product, from a lignocellulosic feedstock, comprising:

(a) contacting a lignocellulosic feedstock with a fluid comprising water to form a reaction mixture, and subjecting the reaction mixture to conditions comprising a temperature in the range of between 150° C. to 250° C. and a pressure in the range of between 200 psig to 1500 psig, for a time period sufficient to generate a reaction slurry product comprising: the at least one cellulose pulp product, the at least one lignin product, the at least one solubilized hemicellulose product, wherein the at least one cellulose pulp product has an alpha number in the range of between 50 and 90;

(b) contacting the at least one cellulose pulp product, with a caustic solution having a pH in the range of between 10 and 14, thereby increasing the alpha number of the at least one cellulose pulp product and generating a high alpha-cellulose pulp product of between 92 and 99 alpha, and generating a spent caustic solution comprising additional solubilized hemicelluloses;

(c) separating the high alpha-cellulose pulp product from the spent caustic solution comprising the additional solubilized hemicelluloses; and (d) separating or extracting the additional solubilized hemicelluloses from the spent caustic solution by:

(i) addition of a solvent having a reduced polarity with relation to water, wherein the reduced polarity solvent comprises water, or a water and a first alcohol, and (ii) separating or extracting the additional solubilized hem icellulose by a process comprising a nanofiltration process.

2. The method or industrial process of claim 1, wherein the lignocellulosic feedstock comprises a low alpha-cellulose kraft pulp, and the low alpha-cellulose kraft pulp comprises a kraft pulp having an alpha cellulose content in the range of between 84% to 88% alpha-cellulose.

3. The method of or industrial process claim 1, wherein the method or industrial process is a batch or a continuous process in a reaction vessel, wherein optionally the reaction vessel comprises a continuously stirred tank reactor, a continuous pipe-type (plug-flow) reactor or an equivalent thereof.

4. The method or industrial process of claim 1, comprising washing cellulose fibers in the at least one high alpha-cellulose pulp to form a washed pulp and washed cellulose fibers, wherein the washing removes non-cellulose impurities.

5. The method or industrial process of claim 4, further comprising beating or fluffing the washed cellulose to generate a de-fiberized cellulose pulp, and optionally the washed cellulose is fluffed or beaten to increase the surface area of the washed cellulose, and optionally the beating or fluffing of the washed cellulose comprises use of a PFI-type mill, and/or by passing the washed cellulose through a refining disc, and optionally further comprising removing impurities or shives or incompletely ground fiber bundles from the de-fiberized cellulose pulp, and optionally further comprising bleaching the de-fiberized cellulose pulp, wherein the bleaching comprises a photo-catalytic oxidation or equivalent thereof, and optionally further comprising a chelation step to reduce mineral content, and optionally further comprising subjecting the de-fiberized cellulose pulp to an extraction step, wherein the extraction step comprises a hot or cold caustic extraction step, to remove any remaining hemicellulose, and optionally to increase the alpha-cellulose content to 95% or more, wherein optionally the hot or cold caustic extraction step is done either before and/or after the bleaching step, or the bleaching step including the chelation step.

6. The method or industrial process of claim 1, further comprising extracting and/or isolating a lignin from the separated or extracted additional solubilized hemicellulose of step 1(d) by a process comprising evaporating or centrifuging the separated or extracted additional solubilized hemicellulose.

7. The method or industrial process of claim 1, wherein the pressure in step 1(a) is between 500 psig to 2000 psig.

8. The method or industrial process of claim 1, wherein in step 1(a) the contacting results in at least one cellulose having an alpha number in the range of between 80 and 90.

9. The method or industrial process of claim 1, wherein the solubilized hemicellulose comprises a xylan, a glucuronoxylan, an arabinoxylan, a glucomannan, a xyloglucan or a combination thereof.

10. The method or industrial process of claim 1, wherein the first alcohol comprises ethanol, methanol, isopropanol, butanol, polyols, propylene glycol, ethylene glycol or combinations thereof.

11. The method or industrial process of claim 1, wherein the lignocellulosic feedstock comprises:

a wood, wherein optionally the wood comprises a hardwood or a softwood;

a cotton fiber;

a plant of the genus *Miscanthus*, wherein a plant of the genus *Miscanthus* is a grass;

a straw;

a cane;

an agricultural or a forestry residue(s), wherein optionally the agricultural residue comprises a corn cob or a corn husk, or a sugar cane bagasse;

a residue generated in an oil palm production or a harvesting or production process of a plant of the family Arecaceae, wherein optionally the plant of the family Arecaceae comprises a palm mesocarp fiber; a palm frond or a palm trunk;

a rice husk or a rice bran; or, any combination thereof.

12. The method or industrial process of claim 1, wherein before the contacting of the lignocellulosic feedstock with the fluid to form the reaction mixture in step 1(a), multiple streams are generated from the lignocellulosic feedstock, and each of the multiple streams comprises independently:

(a) a pulp substantially or primarily comprising a cellulose;

(b) a sugar or a stream substantially or primarily comprising a pentose sugar or plurality of pentose sugars generated from the hemicellulose portion of the lignocellulose material by hydrolysis; and, (c) a lignin or a stream substantially or primarily comprising a lignin.

13. The method or industrial process of claim 1, wherein before the contacting of the lignocellulosic feedstock with the fluid to form the reaction mixture in step 1(a), the lignocellulosic feedstock is first size-reduced, and optionally the feedstock is passed through a sieve to ensure that particles with low degree of polymerization are substantially separated from the feedstock prior to reacting the feedstock.

14. The method or industrial process of claim 1, wherein before the contacting of the lignocellulosic feedstock with the fluid to form the reaction mixture in step 1(a), the lignocellulosic feedstock is transferred to a pre-steaming unit or a reaction vessel comprising low-pressure steam for a low-pressure pre-steaming, wherein optionally the low-pressure steaming comprises conditions at between 10 psig to 50 psig steam, and the low pressured steam is injected into a reaction vessel, wherein the steaming increases the density of the lignocellulosic feedstock by removing air from the lignocellulosic feedstock, and optionally after the pre-steaming process the pre-steamed lignocellulosic feedstock is transferred to a high-pressure pump for introduction into a digestion reactor, and optionally a lignocellulosic feedstock stream is diluted using a solvent, optionally a third alcohol and/or water, to generate a flowable slurry for ease of transporting, and optionally the lignocellulosic feedstock is size-reduced before the low-pressure pre-steaming.

15. The method or industrial process of claim 14, wherein the size-reduced lignocellulosic feedstock, or pre-steamed and size-reduced lignocellulosic feedstock, is transferred to a reaction vessel, a digester or a digestion reactor for digestion, and optionally the transfer is via a high-pressure or other suitable pump, and optionally the size-reduced lignocellulosic feedstock, or pre-steamed and size-reduced lignocellulosic feedstock is mixed with a solvent, optionally a fourth alcohol, optionally ethanol or methanol, or a mixture of an alcohol and water, and optionally the fourth alcohol is between 30% to 70% of the solvent by weight and water makes up the remaining weight of the solvent.

16. The method or industrial process of claim 15, wherein the reaction vessel, digester or digestion reactor is operated in a continuous fashion and/or the solvent contacts the lignocellulosic feedstock either co-currently or counter-currently.

17. The method or industrial process of claim 15, wherein the ratio of solvent-to-lignocellulosic feedstock in the reaction vessel, digester or digestion reactor is between 4:1 to 10:1 by weight, and optionally the reaction vessel is heated to a temperature or between 180° C. to 220° C., and optionally the reaction vessel is maintained at a pressure between 300-700 psig, for a time that is sufficient to allow for lignin and hemicellulose to be cleaved from cellulose polymers in the lignocellulosic feedstock, and optionally the residence time of the lignocellulosic feedstock in the digestion reactor is between 30 min to 120 minutes (min).

18. The method or industrial process of claim 17, wherein:

(a) the reaction vessel is heated to a temperature at 200° C.;

(b) the reaction vessel is maintained at a pressure at 500 psig for a time that is sufficient to allow for lignin and hemicellulose to be cleaved from cellulose polymers in the lignocellulosic feedstock;

(c) the residence time of the lignocellulosic feedstock in the digestion reactor is between 50 min to 100 min; or (d) any combination of (a), (b) or (c).

19. The method or industrial process of claim 15, wherein the sized-reduced lignocellulosic feedstock, or sized-reduced and presteamed lignocellulosic feedstock, is subjected to an auto-hydrolysis step prior to the digestion step, wherein the auto-hydrolysis step comprises mixing the sized-reduced, or sized-reduced and presteamed lignocellulosic feedstock with water in a ratio of between 4:1 to 10:1 water-to-biomass by weight, and heating the mixture to between 150-180° C. in a pressurized vessel, and maintaining at a pressure of between 200-700 psig for a residence time of between 20 min to 120 min, wherein the auto-hydrolysis causes the hemicellulose in the lignocellulosic feedstock to substantially cleave from the lignin and cellulose, thereby generating a relatively or substantially pure oligosaccharide product, optionally comprising primarily C5 (pentose) sugars, wherein optionally the oligosaccharide product can be recovered prior to the digestion reaction, and optionally the auto-hydrolysis increases the porosity of the lignocellulosic feedstock for the digestion.

20. The method or industrial process of claim 18, wherein step 1(a) comprises contacting the lignocellulosic feedstock with a supercritical fluid comprising water to form a reaction mixture, and subjecting the reaction mixture to conditions comprising a temperature in the range of between 150° C. to 250° C. and a pressure in the range of between 200 psig to 1500 psig, for a time period sufficient to generate the reaction slurry product.

21. The method or industrial process of claim 19, wherein the auto-hydrolysis step comprises maintaining at a pressure of between 200-700 psig for a residence time of between 50 min to 100 min.

22. The method or industrial process of claim 15, wherein:

a weak base is added to the digestion reaction mixture to prevent the pH from dropping below pH 3.8; or, a weak acid is added to the digestion reaction to facilitate cleavage of the hemicellulose during the digestion reaction, and optionally the acid or base are added in an amount up to 5% by weight of the lignocellulosic feedstock in the reaction mixture.

23. The method or industrial process of claim 12, wherein:

an aqueous phase comprising a hemicellulose and/or xylo-oligosaccharides (XOS) and a lignin are separated from the cellulose or the pulp stream of claim 12(a), wherein optionally the aqueous phase is sent to a sugar/lignin isolation unit wherein the hemicellulose and/or xylo-oligosaccharides (XOS) are converted to fermentable sugars and separated from the lignin, and optionally the separated hemicellulose and lignin, or the aqueous phase solution or mixture comprising the separated hemicellulose and lignin, and/or any long-chain polysaccharide in the reaction mixture, are converted or hydrolyzed to a sugar, or a fermentable sugar or sugars, and optionally lignin is separated from the fermentable sugar(s), and optionally the separated hemicellulose and lignin is transferred to a reaction vessel or a flash unit wherein the temperature is decreased from the temperature of the digestion reaction vessel to between 140° C. to 150° C., and optionally adjusting or changing the pH of the separated hemicellulose and lignin or reaction mixture to between pH 1.0 to pH 1.5, optionally with the addition of an acid, optionally a sulfuric acid, thereby hydrolyzing long-chain hemicellulose oligosaccharides or xylo-oligosaccharides (XOS), or optionally adding enzymes to hydrolyze the hemicellulose, thereby hydrolyzing long-chain hemicellulose oligosaccharides or xylo-oligosaccharides (XOS), wherein optionally the hydrolyzed long-chain hemicellulose oligosaccharides or xylo-oligosaccharides (XOS) generate primarily short-chain C5 (pentose) sugars, optionally pentose monosaccharides or long-chain sugars or disaccharides.

24. The method or industrial process of claim 1, further comprising before the addition of a solvent having a reduced polarity with relation to water of step 1(d) adding a supercritical fluid to reduce the polarity of the solvent, and optionally the supercritical fluid comprises an alcohol, or optionally the supercritical fluid comprises: carbon dioxide, ammonia, ethane, ethylene, acetone, propane, propylene, nitrous oxide and butane and combination thereof; or, carbon dioxide and one or more co-solvents, and optionally the alcohol comprises ethanol, methanol, isopropanol, butanol, polyols, propylene glycol, ethylene glycol or combinations thereof.

25. The method or industrial process of claim 24, wherein the supercritical fluid comprises a supercritical alcohol.

26. The method or industrial process of claim 25, wherein the supercritical alcohol is or comprises: an ethanol, a methanol, an isopropanol, a butanol, a polyol, a propylene glycol, an ethylene glycol or a combination thereof.

27. The method or industrial process of claim 1, wherein step 1(a) comprises contacting the lignocellulosic feedstock with a fluid comprising water and alcohol to form a reaction mixture, and subjecting the reaction mixture to conditions comprising a temperature in the range of between 150° C. to 250° C. and a pressure in the range of between 200 psig to 1500 psig, for a time period sufficient to generate the reaction slurry product.

28. The method or industrial process of claim 27, wherein the alcohol is or comprises: an ethanol, a methanol, an isopropanol, a butanol, a polyol, a propylene glycol, an ethylene glycol or a combination thereof.

* * * * *